United States Patent [19]

Tanaka et al.

[11] Patent Number: 4,708,903

[45] Date of Patent: Nov. 24, 1987

[54] HEAT-SENSITIVE TRANSFER SHEET

[75] Inventors: Tsuneo Tanaka; Tetsuro Yoshitomi; Koji Hanada; Mashato Ohashi; Michichika Hikosaka, all of Tokyo, Japan

[73] Assignees: Toyo Ink Manufacturing Co., Ltd.; Toppan Printing Co., Ltd., both of Tokyo, Japan.

[21] Appl. No.: 851,342

[22] Filed: Apr. 14, 1986

[30] Foreign Application Priority Data

Apr. 17, 1985 [JP] Japan ..... 60-80075

[51] Int. Cl.[4] ..... B41M 5/26

[52] U.S. Cl. ..... 428/195; 428/200; 428/207; 428/211; 428/212; 428/214; 428/336; 428/339; 428/474.4; 428/484; 428/488.1; 428/488.4; 428/492; 428/497; 428/500; 428/522; 428/532; 428/536; 428/913; 428/914

[58] Field of Search ..... 428/484, 488.1, 488.4, 428/913, 914, 195, 200, 207, 211, 212, 214, 336, 339, 474.4, 492, 497, 500, 522, 532, 534

[56] References Cited

U.S. PATENT DOCUMENTS

| | | | |
|---|---|---|---|
| 2,777,781 | 1/1957 | Kordig et al. | 428/488.4 |
| 3,418,148 | 12/1968 | Barz | 428/488.4 |
| 4,503,095 | 3/1985 | Seto et al. | 428/913 |
| 4,505,983 | 3/1985 | Kuroda et al. | 428/914 |

*Primary Examiner*—Bruce H. Hess

*Attorney, Agent, or Firm*—Bucknam and Archer

[57] ABSTRACT

A heat-sensitive transfer sheet comprising a base film, a first hot melt layer composed mainly of wax, a coloring layer comprising at least one colorant and at least one a resin as a vehicle, and a second hot melt layer composed mainly of wax, these layers being formed on said base film in this order.

8 Claims, 1 Drawing Figure

HEAT-SENSITIVE TRANSFER SHEET

BACKGROUND OF THE INVENTION

1. Field of the Invention

This invention relates to heat transfer ink sheets used for heat-sensitive transfer recording.

2. Description of the Prior Art

Owing to the development of thermal heads, heat-sensitive recording methods have been widely adopted in facsimile apparatus and printers. In these methods, there is used a heat-sensitive recording paper which has generally a heat-sensitive color-forming or chromogenic layer in which two ingredients capable of developing a color on heating are dispersed, the layer being formed on a paper. However, this type of recording paper has the drawbacks that it is unsatisfactory in preservability, it is liable to deteriorate after recording, and it has a poor resistance to solvents. There has been proposed a heat-sensitive transfer material (a heat transfer recording sheet) which has overcome the above drawbacks. The transfer material so proposed has a heat-fusible or hot melt ink layer formed on a support. For recording, the transfer material is superimposed on ordinary paper or the like and subjected to heat generated from a thermal head so as to transfer the ink to the ordinary paper or the like. According to the above recording method, recording on ordinary paper is possible and thus, the drawbacks involved in the known heat-sensitive recording methods can be overcome.

In this recording system, heat generated from the thermal head permits the heat transfer ink to be melted through a support so as to transfer the melted ink to the ordinary paper. Heat transfer ink sheets have been heretofore made by several methods including a hot melt coating method in which a hot melt ink mainly composed of a colorant such as a pigment or dye, a wax and a resin is applied onto a base film and a hot lacquer coating or solvent coating method in which an ink dispersed in a solvent is heated and applied onto a base film. Although the hot melt coating is effected by applying an ink which is a solid at normal temperatures but is turned into liquid on heating while melting the ink by heating, it is disadvantageous in that for example, it will produce an irregular coating on a surface to be coated and that it needs an additional specific apparatus for making a transfer sheet on which different kinds of color inks are selectively applied. The hot lacquer or solvent coating is effected by applying an ink diluted with solvents while heating to a temperature not higher than the melting point of the ink. Japanese Laid-open Patent Application No. 58-128897 discloses a method which comprises applying at normal temperatures an ink having 10 wt% or more of wax dissolved in solvents at normal temperatures. Japanese Laid-open Patent Application No. 59-57791 discloses an improved method in which inks mixed with solvents are subjected to evaporation of the solvents at temperatures below the melting points of the inks and then heated and melted for mixing. These coating methods using solvents as diluents have an advantage in that they allow conventional existing gravure or flexo printers to be utilized. However, several disadvantages are involved. More particularly, since an ink is applied in the form of a dispersion in a solvent in the above methods, irregularities of the resulting coating on the substrate surface can be lessened as compared with the hot melt coating method, but wax is dispersed along with a colorant such as a pigment while being partially dissolved. As a result, even though the wax is very finely dispersed and coated, the irregularities of the coating on the surface cannot be lessened to a satisfactory extent with poor dispersion stability of the wax and pigment. This will lead to the poor stability of the ink at the time of its application by printers and also to settling or sedimentation of the wax and pigment during their storage, thus resulting in poor preservability.

In addition, Japanese Laid-open Patent Application No. 59-114098 describes a heat-sensitive transfer sheet which comprises a base film and a hot melt ink layer and a hot melt wax layer, these layers being formed on the base film in this order. Probably since this heat-sensitive transfer sheet has the ink layer composed mainly of wax and the wax layer superimposed thereon, it will provide a print or record which is not very good because of in sharpness.

SUMMARY OF THE INVENTION

It is accordingly an object of the invention to provide a heat-sensitive transfer sheet whose coating layer is uniform and free of irregularities and which can provide good records on recording by a thermal head.

It is another object of the invention to provide a heat-sensitive transfer material which permits satisfactory multi-color recording.

It is still another object of the invention to provide a heat-sensitive transfer sheet which permits satisfactory recording on a course recording paper which has not been considered to be suitable for good recording in known heat-sensitive transfer recording systems.

According to the present invention, there is provided a heat-sensitive transfer material which comprises a base film, and a hot melt layer composed mainly of wax, a coloring layer having at least one colorant and at least one a resin as the vehicle and a hot melt layer mainly composed of wax formed on the base film in this order. This transfer sheet is advantageous in that the layers formed by coating are not irregular and thus are uniform at normal temperatures without heating and that when the transfer material is used for recording by a thermal head, a uniform record without ink-blur outside of the recorded portion may be obtained not only on a smooth recording paper, but also on a coarse paper. In addition, the print has good sharpness (i.e. printed characters or letters are free of thick defects or fine breaks at tips thereof) and are free of ink stains on the background thereof. In addition, the above transfer sheet also provides multi-color images with better color reproduction than the known heat transfer sheet in which a hot melt ink mainly composed of a colorant such as a pigment or dye, a wax and a resin is applied onto a base film. According to the present invention, the hot melt layer contacting the substrate and the outermost hot melt layer of the transfer sheet can be melted by the heat generated by a thermal head. On the contrary, the coloring layer can be softened, but cannot be melted. Thus, the different ink compositions of the coloring layer of the transfer sheet may be printed one after another on the same portion of a substrate by suitably displacing the transfer sheet for the printing so as to form a plural different colors-overlapped layer without the different ink compositions so printed being mixed with each other. If an ink diluted with a solvent is used in order to form the hot melt layers composed mainly of wax, the color pigment is not substantially contained in the ink, so that settling of the pigment does not occur during storage of the ink. This ensures stable dispersion of the wax. It will be noted that if the hot melt layer is not formed in contact with the base film, the coloring layer comprising a resin vehicle generally exhibits increased adhesiveness to the base film, so that the transfer of the coloring layer from the base film becomes poorer with the result that a record of low density is produced. On the contrary, when the uppermost hot melt layer is not formed, the adhesiveness to a material to be recorded becomes poor and the resulting record has poor sharpness.

BRIEF DESCRIPTION OF THE DRAWING

The single FIGURE is a graphical representation of print densities of different colors recorded by heat transfer in relation to applied voltage in thermal head.

DETAILED DESCRIPTION AND EMBODIMENTS OF THE INVENTION

Figure 1:
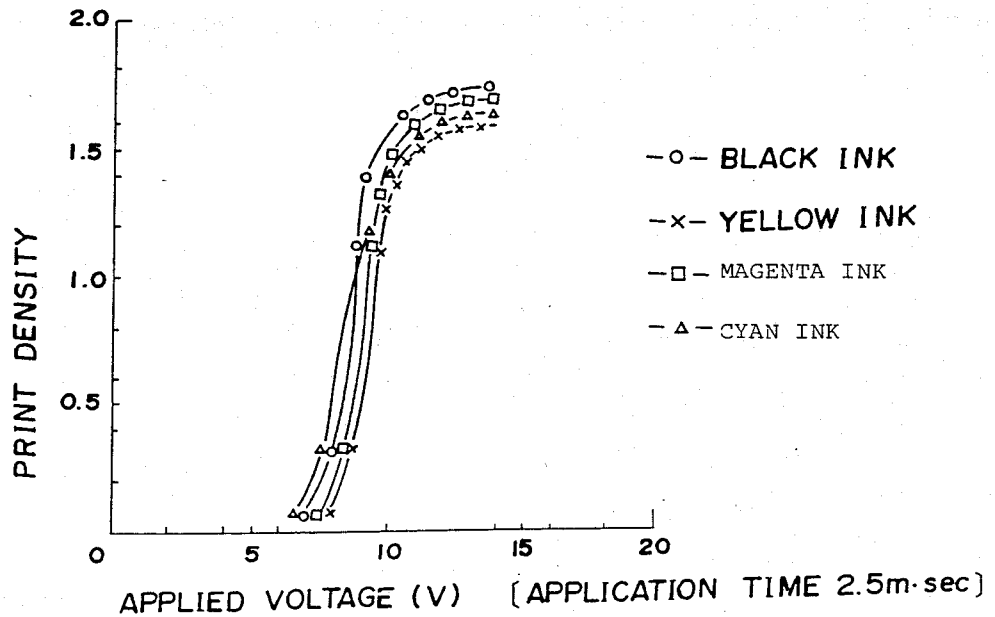

The materials used to form the hot melt layers composed mainly of wax are compositions which comprise a major proportion of waxes ordinarily used for these purposes, resins and fillers or other additives. Examples of the waxes are: natural waxes including plant waxes such as candelilla wax, carnauba wax, rice wax, Japan wax, jojoba oil, and the like and animal oils such as beeswax, lanolin, sperm oil and the like, mineral waxes such as montan wax, ozokerite, ceresin wax and the like, petroleum waxes such as paraffin wax, microcrystalline wax, petrolatum and the like; synthetic waxes including synthetic hydrocarbons such as Fischer-Tropsch wax, polyethylene wax and the like, modified waxes such as montan wax derivatives, paraffin wax derivatives, microcrystalline wax derivatives and the like, hydrogenated waxes such as hardened castor oil, hardened castor oil derivatives and the like; and other waxes such as fatty acids such as lauric acid, palmitic acid, myristic acid, stearic acid, 1,2-hydroxystearic acid and the like, and fatty acid amides. Examples of the resins include acrylic resins, styrene resins, ester resins, rosins, vinyl resins, acetal resins, polyamide resins, rubbers and cellulose derivatives. The fillers include, for example, calcium carbonate, precipitated barium sulfate, silicon dioxide and the like. The ratio by weight of the wax and the resin may be from 100/50 to 100/0. The composition of the hot melt layer may be applied by means of coaters or printers at normal temperatures. Alternatively, hot melt coating systems or hot lacquer or solvent coating systems such as a gravure coating system may be used. With coating systems other than the hot melt coating system, the composition is applied after dilution with a diluting solvent.

The coating may generally be effected by the use of printers or coaters. The coating of the hot melt layer on the coloring layer is preferably effected at normal temperatures. It is to be noted that the hot melt coating technique is not favorable in this case since the hot melt layer adhered to the substrate may melt.

The coloring layer may be made of ink compositions mainly composed of resins, dyes and/or pigments. Such ink compositions include, for example, gravure inks, flexo inks, offset inks and the like. The gravure inks may be aqueous or in a solvent. The resin used in the coloring layer is at least one resin selected from the group consisting of acrylic resins, styrene resins, esters, rosins, vinyl resins, acetal resins, polyamide resins, rubbers, and cellulose derivatives. The content of dyes or pigments in the coloring layer is generally from 5 to 70 wt%. If necessary, the coloring layer may further comprise plasticizers, surface active agents, calcium carbonate, precipitated barium sulfate, silicon dioxide and the like. The coloring layer is, for example, a monochromatic layer, a three-color layer in which yellow, magenta and cyan colorants are coated without overlapping one another or a four-color layer in which yellow, magenta, cyan and black colorants are coated without overlapping one another. In this non-overlapping coating, the respective colorants may be coated in contact with one another or separately from one another.

The wax used in the hot melt layer formed on the substrate may not necessarily be the same as the wax of the hot melt layer formed on the coloring layer.

The coloring layer is preferred to be as thin as possible and is preferably in the range of from 0.1 to 3 micrometers.

The two hot melt layers may have different thicknesses and have most preferably a thickness of from 0.1 to 10 micrometers, respectively.

The substrate used in the present invention includes papers such as condenser paper, heat-resistant films such as of polyesters and polyimides, films having heat-resistant back coating layers, and the like.

The present invention is more particularly described by way of examples, in which parts are all by weight.

EXAMPLE 1

Pre-mixed compositions of the following formulations were each placed into a 5 liter sand mill, in which glass beads having an average size of 1.5 mm were filled to an extent of 60% by volume of the mill, by means of a gear pump at a rate of 2 liters/minute. The sand mill was rotated at a rate of 10 meters/second in each case. As a result, a composition for the hot melt layers and inks of the coloring layer of the following formulations were prepared.

| Composition-A for Hot Melt Layer: | |
|---|---|
| Aqueous dispersion of carnauba wax (note 1) (solid content 20%) | 5 parts |
| Aqueous emulsion of acrylic resin (Liocryl AP-2, made by Toyo Ink Mfg. (Co., Ltd., solid content 27%) | 0.5 parts |
| Water | 1 part |
| Isopropyl alcohol | 1 part |

(Note 1) Carnauba wax having a melting point of 83° to 84° C. was heated to 100° C. and added, portion by portion, to hot water of 90° C. while violently agitating, followed by cooling to room temperature to obtain the aqueous dispersion.

| Inks for Coloring Layers: | |
|---|---|
| Yellow ink composition No. 1 | |
| Aqueous emulsion of acrylic resin (Liocryl AP-2, made by Toyo Ink Mfg. Co., Ltd., solid content 27%) | 5 parts |
| Lionol Yellow GR (C.I. Pigment Yellow 12, by Toyo Ink Mfg. Co., Ltd.) | 0.14 parts |
| Water | 1 part |
| Isopropyl alcohol | 1 part |

Magenta ink composition No. 2

Lionol Yellow GR of the yellow ink composition was replaced by 0.18 parts by weight of Lionol Red B (C.I. Pigment Red 38, made by Toyo Ink Mfg. Co., Ltd.)

Cyan ink composition No. 3

Lionol Yellow GR of the yellow ink composition was replaced by 0.15 parts of Lionol Blue KL (C.I. Pigment Blue 15-3, made by Toyo Ink Mfg. Co., Ltd.)

Black ink composition No. 4

Lionol Yellow GR of the yellow ink composition was replaced by 0.21 parts of carbon black (Mitsubishi Carbon MA-600).

The respective composition A and inks were coated as follows. The composition A was applied onto a 6 micrometer thick polyester film in a thickness of 1.2 micrometers (on a dry basis) by the use of a six-color gravure printer using a solid printing plate. Thereafter, the yellow, red, cyan and black inks were printed on their selective areas of the hot melt layer each in a dry thickness of 0.6 micrometers. Subsequently, another hot melt layer was printed on the coloring layers in a dry thickness of 1.5 micrometers. The above procedure was continuously effected by the gravure printer, thereby obtaining a heat-sensitive transfer sheet having selectively been printed in four colors.

This transfer sheet was used for recording on paper using an ordinary color thermal printer, with a printed matter having clear colors. In FIG. 1, there is shown the relation between optical intensities of the respective colors and applied voltages in thermal head.

COMPARATIVE EXAMPLES 1 AND 2

The general procedure of Example 1 was repeated except that the hot melt layer in direct contact with the polyester film was not formed, thereby obtaining a heat-sensitive transfer sheet (Comparative Example 1) and that the uppermost hot melt layer was not formed, thereby obtaining a heat-sensitive transfer sheet (Comparative Example 2). These heat-sensitive transfer materials were used for recording in the same manner as in Example 1. As a result, it was found that the transfer material of Comparative Example 1 provided a printed matter whose print density was very low, i.e. below 0.1, even when 15 volts were applied. With the transfer material of Comparative Example 2, the ink layers other than the print portions were deposited on the recording paper and thus, a correct print could not be obtained.

EXAMPLE 2

An ink for the hot melt layers and a composition for the coloring layer were prepared in the same manner as in Example 1.

| Composition B for Hot Melt Layer: | |
|---|---|
| Dispersion of carnauba wax in toluene (note 2) (solid content of 23%) | 3 parts |
| Acrylic resin (Hitaloyd 1005, solid content of 40%) | 0.5 parts |
| Toluene | 1 part |
| Ethyl acetate | 0.5 parts |
| Methyl ethyl ketone | 0.5 parts |

(Note 2) Carnauba wax having a melting point of 83° to 84° C. was heated to 100° C. and added, portion by portion, to toluene heated to 90° C. while violently agitating, followed by cooling to room temperature to obtain the dispersion in toluene.

| Ink for Coloring Layer: Black ink composition No. 6 | |
|---|---|
| Solution of rosin-modified phenolic resin in xylene (50% xylene solution of rosin-modified phenolic resin, Tamanol 135, softening point 130–140° C., made by Arakawa Chem. Ind. Co., Ltd.) | 6 parts |
| Carbon black (Mitsubishi Carbon MA 600, by Mitsubishi Chem. Ind. Co., Ltd.) | 0.5 parts |

The resulting inks were applied in the following manner. The composition B was printed on a 3.5 micrometer thick polyester film by the use of a four-color gravure printer in a dry thickness of 1.5 micrometer to form a hot melt layer, on which the black ink No. 6 was printed in a dry thickness of 0.8 micrometers. Thereafter, the composition B was also applied onto the black ink layer in a dry thickness of 1.0 micrometer to form another hot melt layer on the top of the film.

The resulting transfer sheet was used for recording with an ordinary thermal printer by the use of a coarse recording paper having a Bekk smoothness of 10 seconds, thereby obtaining a good print.

EXAMPLES 3–10

Inks of the following formulations were prepared using a sand mill in the same manner as in Example 1.

| | |
|---|---|
| Composition C for Hot Melt Layer: | |
| Finely divided paraffin wax (Paraffin Wax 155 having a melting point of 70° C., made by Nippon Wax Refining Co., Ltd.) | 1 part |
| Solution of 30% rosin-modified maleic resin in isopropyl alcohol (isopropyl alcohol solution of Markeed 300, by Arakawa Chem. Ind. Co., Ltd.) | 0.1 part |
| Isopropyl alcohol | 3 parts |
| Methyl isobutyl ketone | 0.5 parts |
| Composition D for Hot Melt Layer: | |
| Solution of rosin-modified phenolic resin in isopropyl alcohol (xylene solution of 50% rosin-modified phenolic resin, Tamanol 135, by Arakawa Chem. Ind. Co., Ltd.) | 0.1 part |
| Synthetic wax (Diacarna 30, marketed by Mitsubishi Chem. Co. | 3 parts |
| Montan wax (Hoechst wax, by Hoechst Inc.) | 1 part |
| Polyamide resin (Versamide 335, softening point 105–115° C., by Henkel Hakusui Co., Ltd.) | 1 part |
| Silicon oxide (Aerosil 3000, by Nippon Aerosil Co., Ltd.) | 0.5 parts |
| Toluene | 3 parts |
| Isopropyl alcohol | 1 part |
| Cyan Ink No. 7 for Coloring Layer: | |
| Cyclized rubber (Thermorite N, softening point 60° C., by Seiko Chem. Co., Ltd.) | 3 parts |
| Copper phthalocyanine (Cyanine Blue BN, by Toyo Ink Mfg. Co., Ltd.) | 0.5 parts |
| Toluene | 1 part |
| Ethyl acetate | 0.5 parts |
| Methyl isobutyl ketone | 0.5 parts |
| Black Ink No. 8 for Coloring Layer: | |
| Ketone resin (Hilack 111, softening point 100–120° C., by Hitachi Chem. Ind. Co., Ltd.) | 3 parts |
| Carbon black (Mitsubishi Carbon MA-7, by Mitsubishi Chem. Ind. Co., Ltd.) | 0.5 parts |
| Toluene | 3 parts |
| Isopropyl alcohol | 1 part |

The above inks were used to make transfer sheets in the same manner as in Example 2. The thus made transfer sheets had the constructions shown in Table 1 below.

The heat-sensitive transfer sheets of Examples 3 to 10 were each used for recording with a thermal printer, thereby obtaining good prints.

The heat-sensitive transfer sheets of Examples 4, 5, 6 and 8 were also used for recording on coarse recording paper having a Bekk smoothness of 20 seconds by the use of an ordinary thermal printer, with the result that printed letters or characters did not become blurred or scratchy and thus good prints could be obtained.

Moreover, the heat-sensitive transfer sheet of Example 10 was used for recording, with a mat print.

TABLE 1

| Example | Substrate (thickness) | Composition used as hot melt layer contacting the substrate (thickness of the hot melt layer) | Coloring ink layer (thickness) | Composition used as the outermost hot melt layer (thickness) |
|---|---|---|---|---|
| 3 | condenser paper (10 μm) | C (1.0 μm) | No. 7 (0.5 μm) | D (1.5 μm) |
| 4 | polyester film (3.5 μm) having a thermosetting urethane resin layer (0.1 μm) (note 3) | B (2.0 μm) | No. 8 (0.8 μm) | B (1.0 μm) |
| 5 | polyester film (3.5 μm) | A (2.5 μm) | No. 4 (1.0 μm) | B (1.0 μm) |
| 6 | polyester film (3.5 μm) | B (1.0 μm) | No. 7 (6.8 μm) | D (1.8 μm) |
| 7 | condenser paper (10 μm) | D (1.0 μm) | No. 8 (1.0 μm) | D (1.5 μm) |
| 8 | polyester film (5.7 μm) | C (2.0 μm) | No. 4 (1.0 μm) | C (1.5 μm) |
| 9 | polyimide film (25 μm) | D (1.3 μm) | No. 3 (2.0 μm) | C (0.8 μm) |
| 10 | polyester film (3.5 μm) | D (1.0 μm) | No. 8 (1.5 μm) | D (1.5 μm) |

(Note 3)
The ink layers were formed on the side of the polyester film opposite to the side where the thermosetting urethane resin layer had been formed.

EXAMPLE 11

A composition E for hot melt layer was prepared in the same manner as ink B of Example 2 except that a dispersion of carnauba wax in toluene (solid content of 5%). The composition was solid-printed on a 3.5 micrometer thick polyester film in the same manner as in Example 2, followed by printing the black ink No. 6 in the same manner as in Example 2. Moreover, the ink B was formed on the black ink layer in a thickness of 1.0 micrometer to form a hot melt layer.

The resulting transfer sheet was used for recording on a coarse paper having a Bekk smoothness of 10 seconds by means of an ordinary thermal printer, with a good print.

COMPARATIVE EXAMPLES 3 AND 4

The general procedure of Example 11 was repeated except that the composition E was not coated, thereby obtaining a heat-sensitive transfer sheet (Comparative Example 3) and that the composition B was not coated, thereby obtaining a heat-sensitive transfer sheet (Comparative Example 4).

These heat-sensitive transfer sheets were used for recording in the same manner as in Example 11. The material of Comparative Example 3 provided a print whose density was below 0.1 on application of a voltage as high as 15 volts. On the other hand, with the sheet of Comparative Example 4, deposition of the ink was observed on the background.

EXAMPLE 12

In the black ink composition No. 6 of Example 2, the xylene solution of rosin-modified phenolic resin was replaced by a solution of 50% styrene-acrylic copolymer (Acrybase MH-7015, by Fujikura Chem. Co., Ltd.) in toluene. The general procedure of Example 2 was repeated using the above solution, thereby obtaining a heat-sensitive transfer sheet.

EXAMPLE 13

The general procedure of Example 2 was repeated except that the xylene solution of rosin-modified phenolic resin of the black ink composition No. 6 was replaced by a toluene solution of 50% ethylene-vinyl acetate copolymer (Evaflex 577-2, by Mitsui Polychemical Co., Ltd.), thereby obtaining a heat-sensitive transfer material.

EXAMPLE 14

The general procedure of Example 2 was repeated except that the xylene solution of rosin-modified phenolic resin of the black ink composition No. 6 was replaced by a methyl ethyl ketone solution of 15% polyester resin (Vylon 200, by Toyobo Co., Ltd.), thereby obtaining a heat-sensitive transfer material.

The heat-sensitive transfer materials of Examples 12 to 14 were used for recording on paper (Bekk smoothness of 10 seconds) by the use of a thermal printer, with good prints.

EXAMPLE 15

Following the procedure of Example 1, the following compositions for hot melt layers and inks for coloring layers were prepared.

| | |
|---|---|
| Composition F for Hot Melt Layer: | |
| Powdered rice wax (CP-200, melting point 80° C., produced by Noda Wax Co., Ltd.) | 1 part |
| Polyvinyl butyral (S-LEC BLS, produced by Sekisui Chemical Co., Ltd.) | 0.05 parts |
| Isopropyl alcohol | 5 parts |
| Composition G for Hot Melt Layer: | |
| Rice wax | 0.5 parts |
| Carnauba wax | 0.25 parts |
| Microcrystalline wax (Hi-Mic-2065, m.p. 25° C., produced by Nippon Seiro Co., Ltd.) | 0.25 parts |
| A 50% solution of ethylene-vinyl acetate in toluene | 0.1 part |
| Toluene | 5 parts |
| Ink for Coloring Layer: | |
| Yellow ink composition No. 9 | |
| Evaflex 577-2 | 0.14 parts |
| Lionol Yellow GR | 0.14 parts |
| Xylene | 2.0 parts |

-continued

| | |
|---|---|
| Magenta ink composition No. 10 | |
| Evaflex 577-2 | 0.14 parts |
| Lionel Red 6B (C.I. Pigment Red 57) | 0.18 parts |
| Xylene | 2.0 parts |
| Cyan ink composition No. 11 | |
| Evaflex 577-2 | 0.14 parts |
| Lionol Blue KL | 0.15 parts |
| Xylene | 2.0 parts |

The procedure of Example 1 was followed except that the composition G was printed in substitution for the composition A, each of the ink compositions so prepared was printed and then the composition F was printed in place of the composition A, whereby color sheets (heat-sensitive transfer sheets) were obtained.

These color sheets were used to effect multi-color printing by a color thermal printer (Shinko CHC-33 produced by Shinko Electric Co., Ltd.) with the result that multi-color prints having a clear hue were obtained. Comparative Example 3

The following materials of each of the ink compositions were mixed and kneaded together with a three-roll mixer under heat thereby to obtain a hot melt ink.

| | |
|---|---|
| Yellow ink composition No. 12 | |
| Evaflex 577-2 | 1.0 part |
| Lionol Yellow GR | 1.4 parts |
| Paraffin Wax 155 | 7.6 parts |
| Magenta ink composition No. 13 | |
| Evaflex 577-2 | 1.0 part |
| Lionol Red 6B | 1.8 parts |
| Paraffin Wax 155 | 7.2 parts |
| Cyan ink composition No. 14 | |
| Evaflex 577-2 | 1.0 part |
| Lionol Blue KL | 1.5 parts |
| Paraffin Wax 155 | 7.5 parts |

The hot melt inks so obtained were printed in a thickness of 2.8 μm and a predetermined size by a flexo hot melt printer to obtain color transfer sheets. The transfer sheets so obtained were used in multi-color printing in the same manner as in Example 15 with the result that the prints thus obtained were all lacking in clearness and the black hue produced by overlapping three color ink layers one another was particularly lacking in clearness.

As will be apparent from the foregoing, the inks and compositions used in the present invention have good stability during storage and application, so that uniform and good heat-sensitive transfer sheets can be obtained. The prints obtained by heat transfer using the heat-sensitive transfer sheet have good abrasion resistance since the outermost layer is a hot melt layer which does not contain a large amount of pigments. On the contrary, when the outermost layer is a layer containing extender pigments, the resulting print can be kept mat.

What is claimed is:

1. A heat-sensitive transfer sheet comprising (1) a base film, (2) a first hot melt layer composed mainly of wax, (3) a coloring layer comprising at least one colorant selected from the group consisting of dyes and pigments, and as a vehicle at least one resin selected from the group consisting of acrylic resins, styrene resins, ester resins, rosins, vinyl resins, acetal resins, polyamide resins, rubbers and cellulose derivatives, and (4) a second hot melt layer composed mainly of wax, said layers being formed on said base film in this order, whereby said second layer is the top layer.

2. A heat-sensitive transfer sheet according to claim 1, wherein each of the first and second hot melt layers additionally comprises a resin.

3. A heat-sensitive transfer sheet according to claim 2, wherein the wax and the resin are present in a ratio by weight of up to 100 parts of the wax to 50 parts of the resin by weight.

4. The sheet according to claim 3, wherein the wax in the first and second hot melt layer is carnauba wax and the resin is an acrylic resin.

5. The sheet according to claim 3, wherein the wax in the first hot melt layer is paraffin wax and in the second hot melt layer is a synthetic wax.

6. The sheet according to claim 1, wherein the coloring layer is in the range of 0.1–3 micrometers.

7. The sheet according to claim 1, wherein said coloring layer is a monochromatic layer, a three-color layer or a four-color layer.

8. The sheet according to claim 1, wherein said coloring layer does not melt under heat transfer conditions.

* * * * *